US005655239A

United States Patent [19]

Caparon et al.

[11] Patent Number: 5,655,239

[45] Date of Patent: Aug. 12, 1997

[54] CELLULAR AIR LOSS MATTRESS SYSTEM

[75] Inventors: Christopher C. Caparon, La Verne; Kurt M. Sabin, Alta Loma; Craig S. Miller, Jr., Corona; Craig S. Miller, Sr., Yorba Linda, all of Calif.

[73] Assignee: Joerns Healthcare, Inc., Stevens Point, Wis.

[21] Appl. No.: 710,773

[22] Filed: Sep. 20, 1996

Related U.S. Application Data

[60] Provisional application No. 60/006,458 Nov. 13, 1995.

[51] Int. Cl. [6] ..... A47C 27/10; A61G 7/057

[52] U.S. Cl. ..... 5/713; 5/714; 5/914; 5/932; 156/272.2

[58] Field of Search ..... 5/713, 714, 711, 5/710, 914, 706, 932; 156/272.2

[56] References Cited

U.S. PATENT DOCUMENTS 3,822,425 7/1974 Scales ..... 5/714

4,944,060 7/1990 Peery et al. ..... 5/713

5,090,077 2/1992 Caden et al. ..... 5/713

*Primary Examiner*—Alexander Grosz

*Attorney, Agent, or Firm*—Christie, Parker & Hale, LLP

[57] ABSTRACT

Generally, the present invention is directed to a cellular air loss mattress system comprising an air mattress and an air supply means. Cells of the mattress system are welded onto a unitary top piece and a unitary bottom piece. Means for supplying air, preferably an air blower, is connected to the center cell (also referred to as the pelvic cell) via a supply hose. The air exiting the air blower travels through the supply hose and fills the center cell. The air is allowed to directly travel into adjacent cells via internal air connectors. The inner diameter of each air connector is adjusted to create different pressure zones within the air mattress to support the different pressure requirements of a patient's body. The highest pressure zone is the center cell that initially receives air from the air supply means. The pressure decreases as air moves from the center cell to adjacent cells. The top piece of the air mattress preferably has a plurality of tiny holes that allows for air to escape to help maintain the patients skin and to help prevent skin breakdown.

14 Claims, 9 Drawing Sheets

CELLULAR AIR LOSS MATTRESS SYSTEM

RELATED APPLICATION

This application claims priority of provisional patent application Ser. No. 60/006,458, filed Nov. 13, 1995.

1. Field of the Invention

The present invention relates to a therapeutic air bed such as utilized in hospitals and other convalescent facilities to provide support for patients during long periods of convalescence.

2. Background of the Invention

Therapeutic air beds having multiple air cells disposed in side by side relation and forming an air inflated patient support are well known. One such example is U.S. Pat. No. 5,090,077 issued to Caden et al. on Feb. 25, 1992, the disclosure of which is incorporated by reference herein. In most cases, these air controlled patient support systems are divided into body support segments that are maintained at different pressures to support different parts of a patient's body. For example, the air cells of most therapeutic air beds are arranged into a plurality of segments, each segment being maintained at a preselected pressure range for support of a particular portion of the patient's body. It is typical for such therapeutic air beds to have five or more patient body support segments each at different pressures.

The air supply systems and air cell pressure control mechanisms for air beds having a number of patient support segments are typically quite complex and are therefore quite expensive. It is desirable to provide a novel therapeutic air bed arrangement that having a plurality of patient body support sections and which is of quite simple and inexpensive nature and is reliable in use.

Therapeutic air beds are particularly used by patients who are likely to be bedridden for a significant period of time and are likely to be immobile for extended periods. These patients are typically subject to the development of pressure induced lesions if conventional hospital beds are employed. These pressure induced lesions develop because the capillaries in the skin of the patient are compressed and blood flow is restricted due to the mechanical interface pressure that is caused by the weight of the patient and the resistance of the patient support surface of the bed. Due to insufficient blood flow, the skin in these high pressure areas begins to deteriorate and pressure lesions ultimately result as the skin tissue deteriorates. Therapeutic air beds were developed in general to accommodate patients who are likely to be bedridden for extended periods of time or likely to be immobile for extended periods and patients who have particular skin problems such as burns. The material from which the upper portion of the air beds is composed tends to form about the patient's body to a certain extent, thereby evenly distributing the weight of the patient to the supporting surface of the air bed. This feature minimizes the likelihood that any particular portion of the patient's body will be subjected to sufficient mechanical pressure that blood flow to skin tissues will be impeded. Therapeutic air beds, therefore, minimize the possibility that patients will develop pressure induced lesions.

Another important aspect of therapeutic air beds is that many of them provide for circulation of air from the air cells upwardly to the patient support structure of the air bed and also to the patient. This gentle upward flow of air is typically emitted from a plurality of holes along the upper surface of the air cells or through perforations formed when the material of the air cells is sewn or through porous material of the air cells themselves. This flowing air is effective to remove moisture from the material of the air bed so that the therapeutic value of the air bed will not be impeded by moisture. It is desirable to provide an air bed construction of simple and efficient nature which is capable of continuously emitting a gentle upward flow of air through the material of the patient support system to therefore provide for patient comfort and to enhance the therapeutic aspects of the air bed construction.

SUMMARY OF THE INVENTION

Generally, the present invention is directed to a cellular air loss mattress system comprising an air mattress and an air supply means. The mattress comprises a plurality of cells welded onto a unitary top piece and a unitary bottom piece. Means for supplying air, preferably an air blower, is connected to the center cell (also referred to as the pelvic cell) via a supply hose or manifold. The air exiting the air blower travels through the supply hose and fills the center cell. The air is allowed to directly travel into adjacent cells via internal air connectors or exit out the holes in the top piece.

The inner diameter of each air connector is adjusted to create different pressure zones within the air mattress to support the different pressure requirements of a patient's body. The highest pressure zone is the center cell that initially receives air from the air supply means. The pressure decreases as air moves from the center cell to adjacent cells. The top piece of the air mattress preferably has a plurality of tiny holes that allows for air to escape to help maintain the patients skin and to help prevent skin breakdown.

BRIEF DESCRIPTION OF THE DRAWINGS

Embodiments of the invention will now be described with reference to the following drawings which.

DETAILED DESCRIPTION

Figure 1:
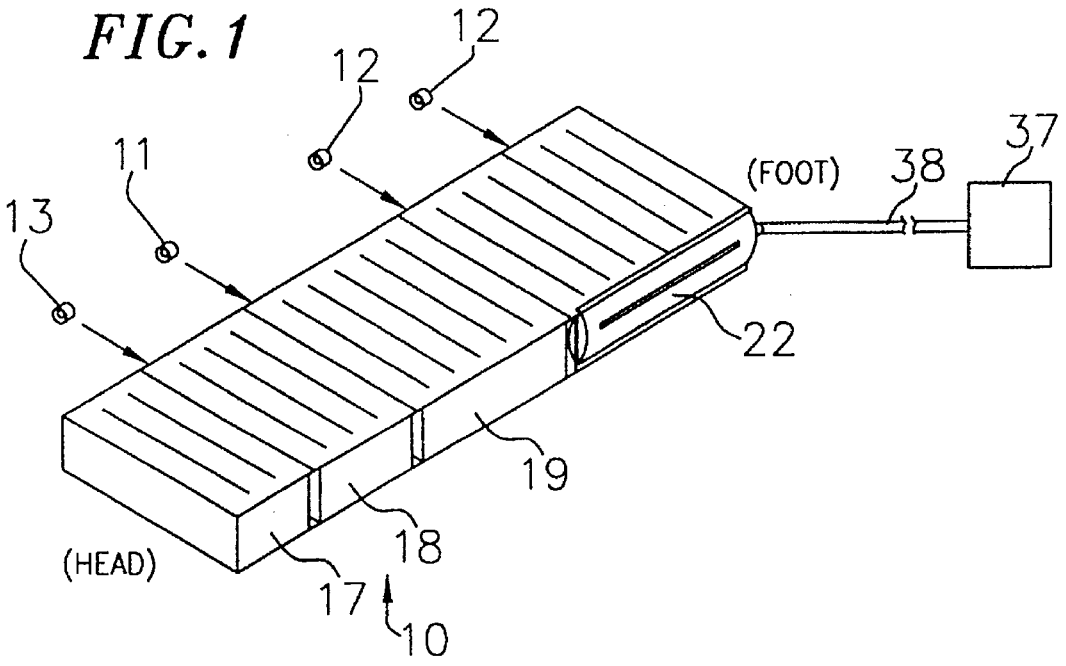
FIG. 1 is a partially exploded perspective view of a cellular air loss mattress system of the present invention.
Figure 1A:
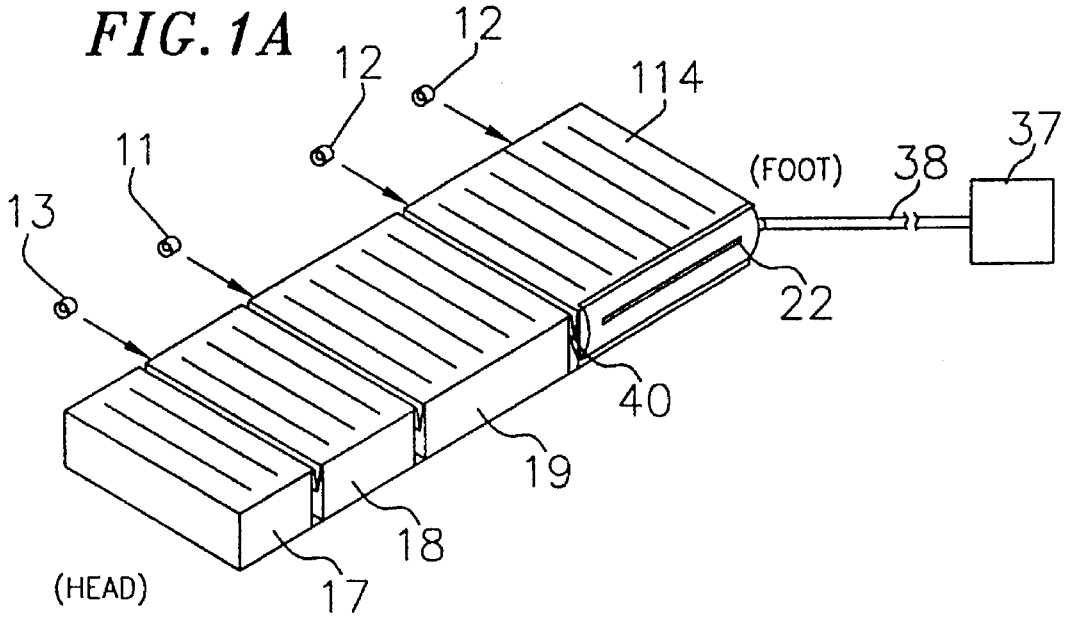
FIG. 1A is a partially exploded perspective view of an alternate embodiment of a cellular air loss mattress system of the present invention.
Figure 2:
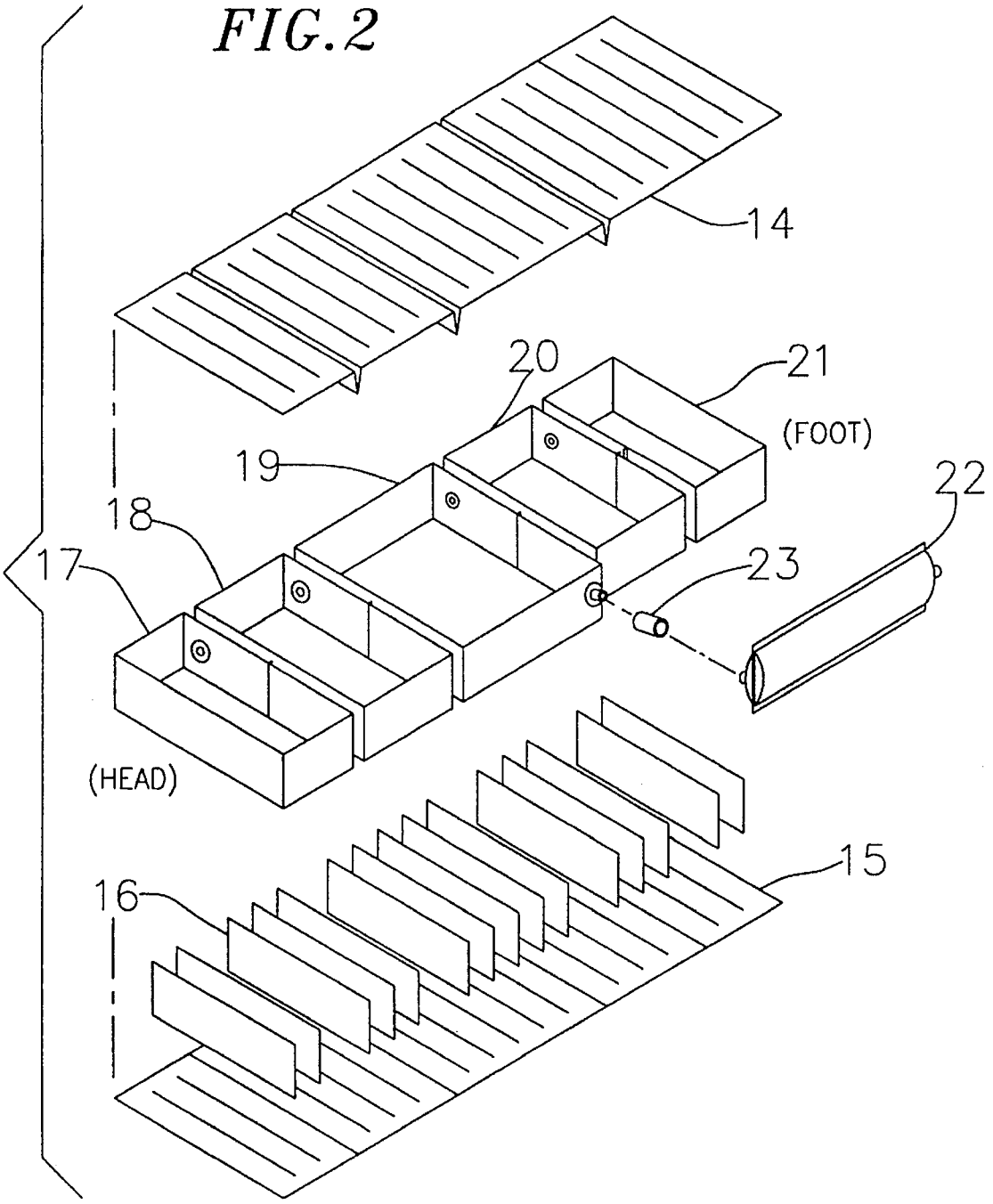
FIG. 2 is an exploded perspective view of the embodiment of FIG. 1A.

Referring now to FIGS. 1, 1A and 2, the cellular air mattress system of the present invention is depicted. The air mattress 10 comprises five different cells that relate to the anatomy of a patient. The cells are the head cell 17, a chest cell 18, a center (pelvic) cell 19, a leg cell 20 and a foot cell 21. The five different cells are constructed out of five different gussets that are welded to a unitary top piece 14 and a unitary bottom piece 15. The material used to make the air mattress can be any suitable weldable material known in the air mattress art. In the preferred embodiment, the material used to construct the air mattress is a urethane coated nylon material manufactured by Brookwood Industries in New York.

A plurality of baffles 16 are located within each cell. The baffles are welded to the top and bottom pieces along their length. The baffles do not span the entire width of the top and bottom sheet leaving a gap along the edges of the baffles. The baffle edges are allowed to float freely within the air mattress allowing for uniform pressure within each cell. The baffles prevent the air mattress from ballooning out and provide a relatively flat surface for the mattress to lay on a hospital bed or the like and for a patient to lay on the mattress. In the preferred embodiment, the baffles are made out of the same material as the top and bottom pieces and the gussets.

A presently preferred optional feature depicted in FIGS. 1 and 2 is a manifold 22 that is welded along one side of the air mattress adjacent to the leg and foot cells. The manifold serves two functions: first it provides an easy access point for a connection from the air supply means 37 to the center cell; and second, it provides a means for heat dissipation. Typically air exiting from an air blower is warm due to the electric motor that runs the blower. The manifold provides about a fourteen degree heat loss when the air mattress is operated at room temperature. A cylindrical hollow connector 23 connects the manifold air outlet to the center cell air inlet.

Also depicted in FIGS. 1, 1A and in the figures of the gussets are internal air connectors. In the preferred embodiment, the internal air connectors are located along the opposite side from the manifold. The internal air connectors comprise a female flange 26, a male flange 29 inserted into the female flange, and a hollow cylindrical pressure insert 11, 12, or 13 inserted into the male flange. As illustrated in FIG. 1, the pressure inserts have different inner diameters. The pressure insert between the center (or pelvic) cell to the chest cell has an inner diameter of about 0.312 inch, the pressure insert between the chest cell and the head cell has an inner diameter of about 0.190 inch, and the pressure inserts between the pelvic cell and the leg cell and the leg cell and the heel cell both have an inner diameter of about 0.172 inch. The different inner diameters allows for the different pressures in each cell to comport with the needs of the patient. In the preferred embodiment, the flanges are made out of urethane to allow for welding to the gussets. The pressure inserts in the preferred embodiment are constructed out of a cylindrically shaped hard plastic material.

Figure 3:
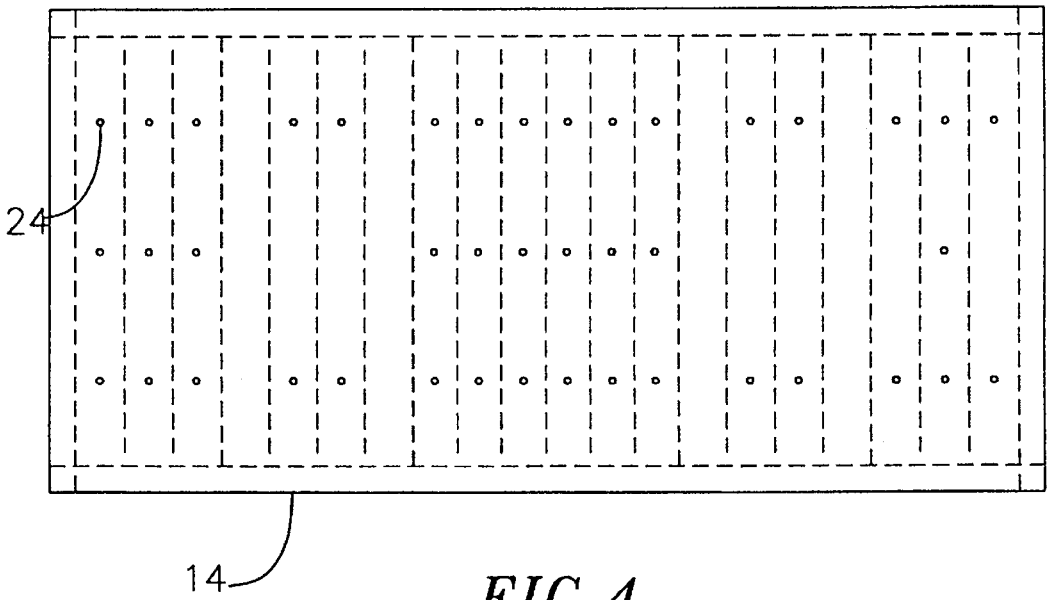
FIG. 3 is a plan view of a top sheet of the present invention.

Turning now to FIG. 3, the top piece 14 is illustrated. In one embodiment, the top piece is a unitary piece of weldable material that is rectangular in shape and is about 87 inches long by about 39 inches wide. The weld lines are also depicted in FIG. 3. The weld lines for the gussets are the lines extending the length of the top piece and the width lines connected to the length lines. The weld lines for the baffles are the width lines that do not extend to the length lines. In the preferred embodiment, there are five gussets and fifteen baffles. A plurality of holes 24 are drilled into the top piece to allow for the escape of air from the air mattress. The holes are preferable centered from the baffles and the gussets and have a diameter of about 0.065 inch to about 0.080 inch with a preferred range of about 0.065 to about 0.075 inch.

In a preferred embodiment illustrated in FIG. 1A, a longer top piece, about 96 inches long, is utilized. The additional material is folded into small V-shaped wedges 40 at the intersection of adjacent gussets to isolate the motion of one gusset from another. Three wedges are formed from the additional 9 inches of material, at the intersection of the head and chest, the chest and pelvic, and the pelvic and leg gussets, each wedge extending approximately 1.5 inches down from the top sheet between the adjacent gussets.

Figure 4:
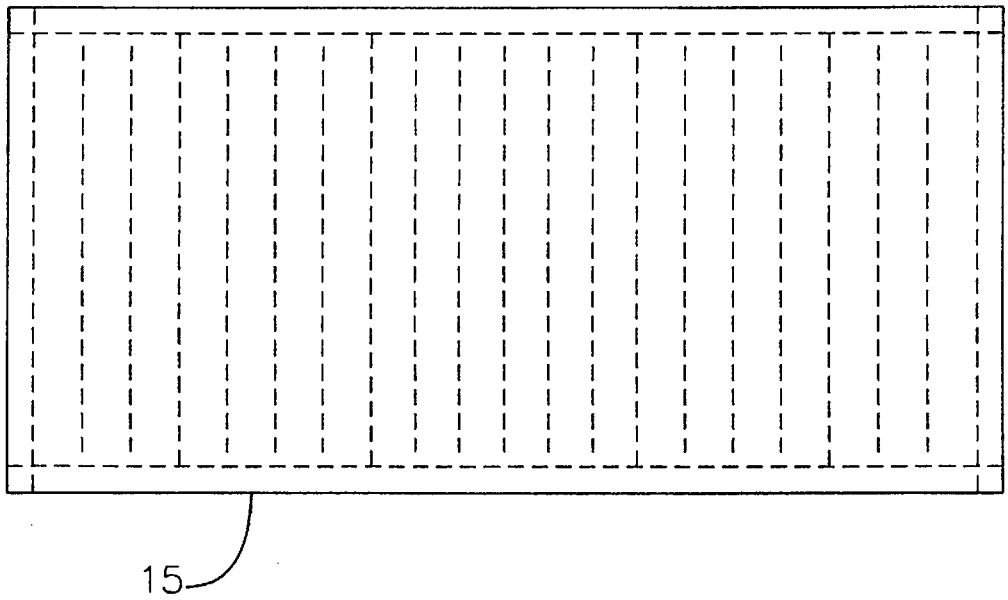
FIG. 4 is a plan view of a bottom sheet of the present invention.

Turning now to FIG. 4, the bottom piece 15 is illustrated. In the preferred embodiment, the bottom piece is also made out of a unitary piece of weldable material that is rectangular in shape and is about 87 inches long by about 39 inches wide. The gusset weld lines and the baffle weld lines are also depicted.

Figure 5:
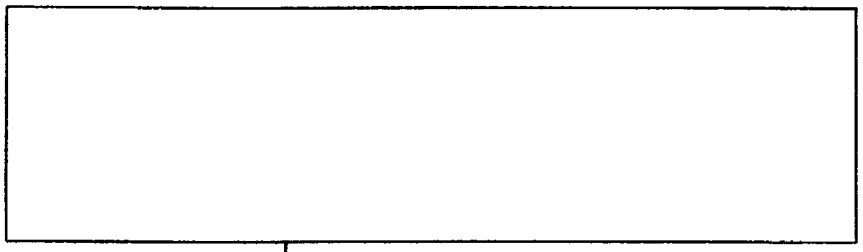
FIG. 5 is a plan view of a baffle of the present invention.

A baffle 16 is illustrated in FIG. 5. In the preferred embodiment, each baffle comprise a unitary piece of weldable material that is rectangular in shape and is about 31 inches long by about 9 inches wide. Fifteen baffles are placed along the widths of the top and bottom pieces as illustrated in FIGS. 3 and 4. As is readily apparent, the baffles do not span the entire widths of the top and bottom pieces. In the preferred embodiment, there is a gap of about 3 to about 4 inches between each and of the baffles and the sides of the top and bottom pieces. Once the gussets are welded into place, there is a gap of about 2 inches between one edge of the baffles and the side walls of the gussets opposite the manifold, and a gap of about 3 inches between the other edge of the baffles and the head, chest and pelvic gusset wall and a gap of about one inch between the other edge of the baffles and the leg and heel gussets.

Figure 6:
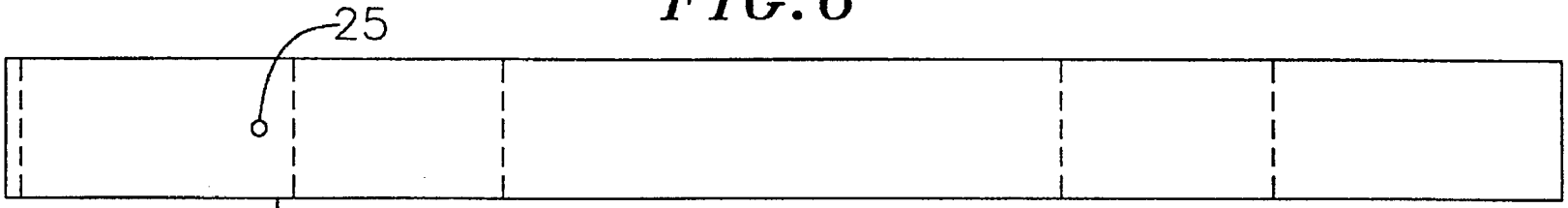
FIG. 6 is a plan view of a head gusset of the present invention.
Figure 7:
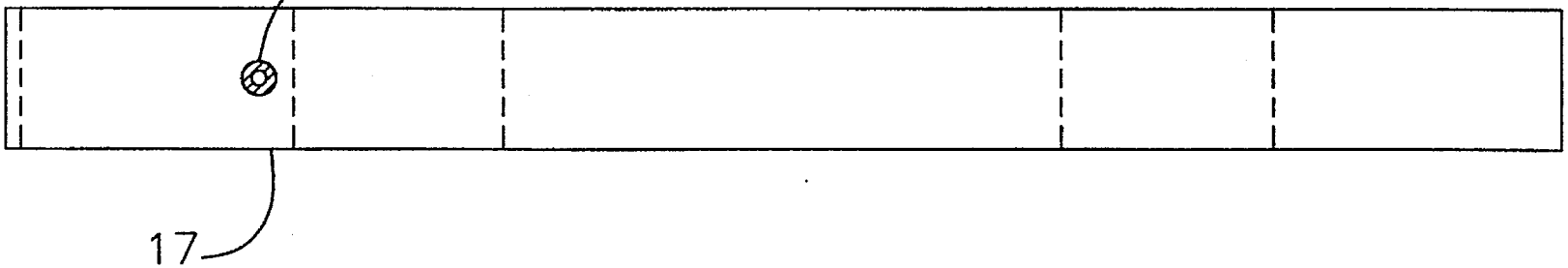
FIG. 7 is a plan view of the head gusset of FIG. 6 with a flange in place.

The head gusset 17 is illustrated in FIGS. 6 and 7. In the preferred embodiment, the head gusset is constructed from a unitary piece of weldable material that is rectangular in shape and is about 95 inches long by about 9 inches wide. A one inch diameter hole 25 is punched into the head gusset about 15.5 inches from one side. A female flange 26 is inserted into the hole and welded into place. In the preferred embodiment, the flange is made out of urethane. The dimensions of the head gusset are to correspond to the size of the head cell of the air mattress, which are about 36 inches wide and about 12 inches long. The actual dimensions of the head gusset in place in the mattress is slightly smaller than 36 inches by 12 inches due to the presence of ring dies during the welding of the air mattress as described below.

Figure 8:
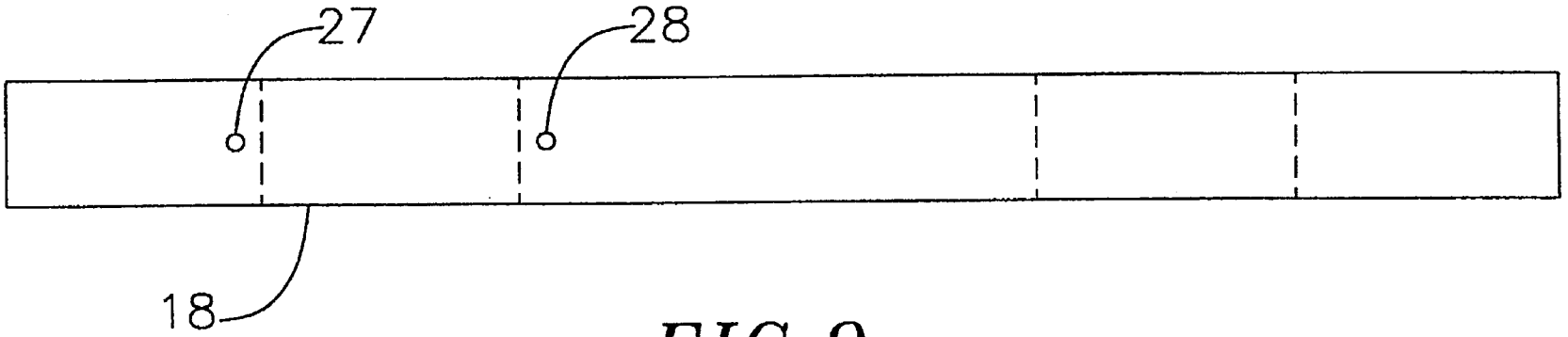
FIG. 8 is a plan view of a chest gusset of the present invention.
Figure 9:
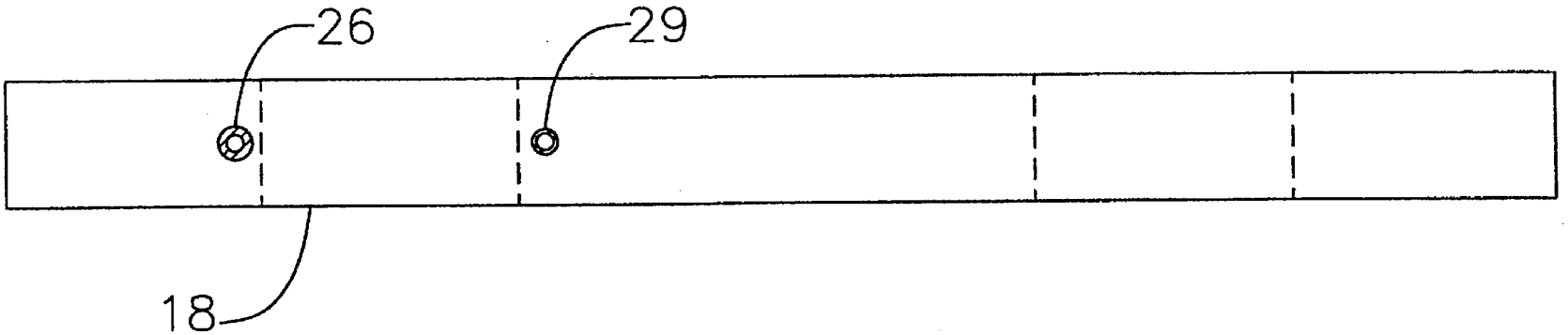
FIG. 9 is a plan view of the chest gusset of FIG. 8 with two flanges in place.

A chest gusset 18 is illustrated in FIGS. 8 and 9. In the preferred embodiment, the chest gusset is constructed from a unitary piece of weldable material that is rectangular in shape and is about 103 inches long by about 9 inches wide. A one inch diameter hole 27 is punched into the chest gusset about 15.5 inches from one side. A 0.62 inch diameter hole 28 is punched into the chest gusset about 35.5 inches from the same side as hole 27. A female flange 26 is inserted into hole 27 and a male flange 29 is inserted into hole 28. Both flanges are welded into place. In the preferred embodiment, both flanges are made out of urethane. The dimensions of the chest gusset are to correspond to the size of the chest cell of the air mattress, being about 36 inches wide and about 16 inches long.

Figure 10:
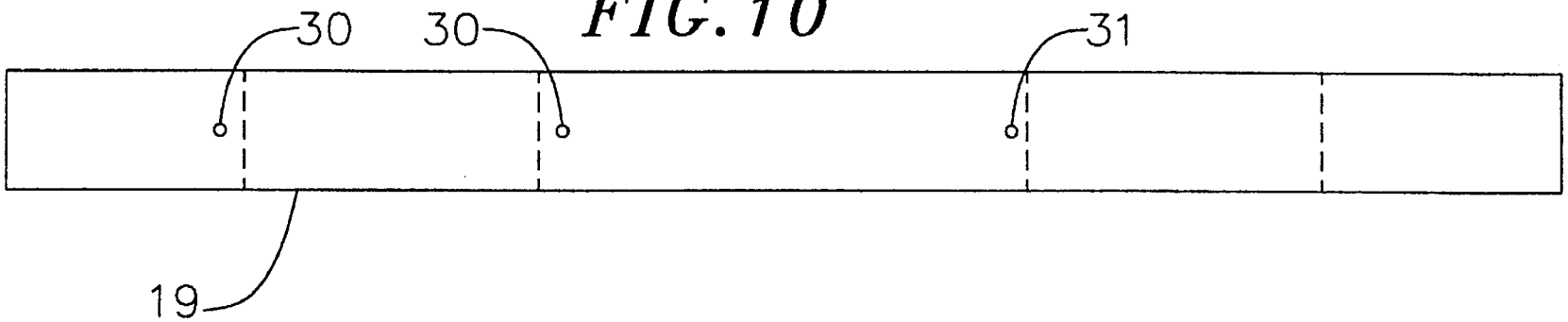
FIG. 10 is a plan view of a pelvic gusset of the present invention.
Figure 11:
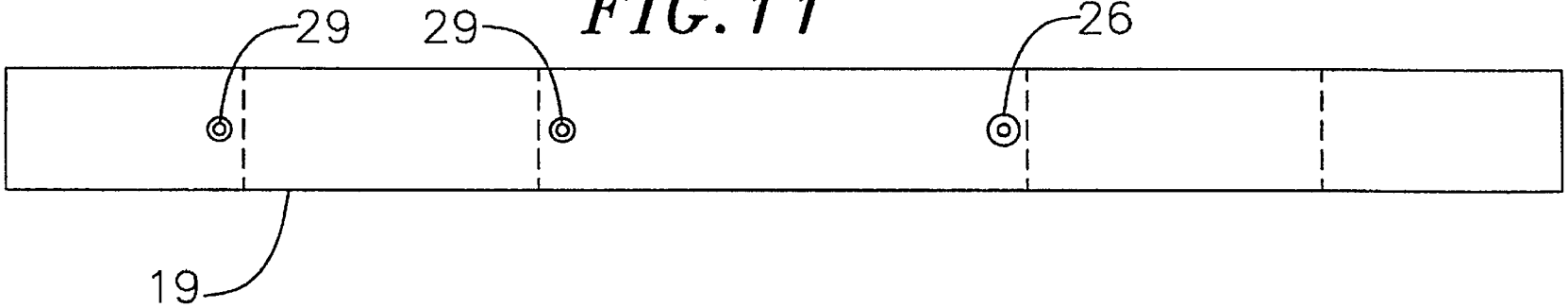
FIG. 11 is a plan view of the pelvic gusset of FIG. 10 with three flanges in place.

A center or pelvic gusset 19 is illustrated in FIGS. 10 and 11. In the preferred embodiment, the center gusset is constructed from a unitary piece of weldable material that is rectangular in shape and is about 119 inches long by about 9 inches wide. Two 0.62 diameter holes 30 are punched into the center gusset, one hole about 15.5 inches from a side and the other hole about 43.5 inches from the same side. A one inch diameter hole 31 is punched into the center gusset about 75.5 inches from the same side as holes 30. A female sized flange 26 is inserted into hole 31 and two male flanges 29 are inserted into the two holes 30. All of the flanges are welded into place. In the preferred embodiment, the flanges are made out of urethane. The dimensions of the center gusset are to correspond to the size of the center cell of the air mattress, being about 36 inches wide and about 24 inches long.

Figure 12:
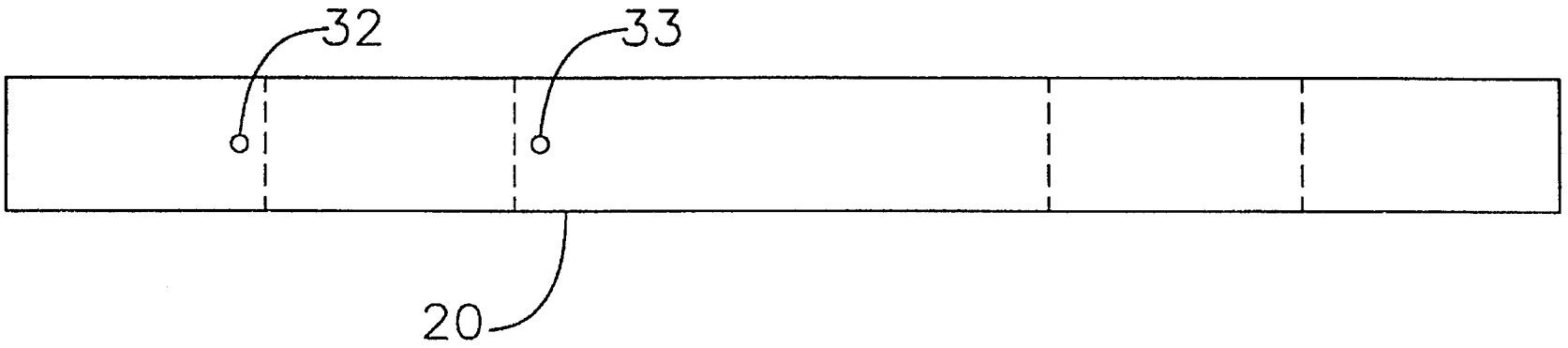
FIG. 12 is a plan view of a leg gusset of the present invention.
Figure 13:
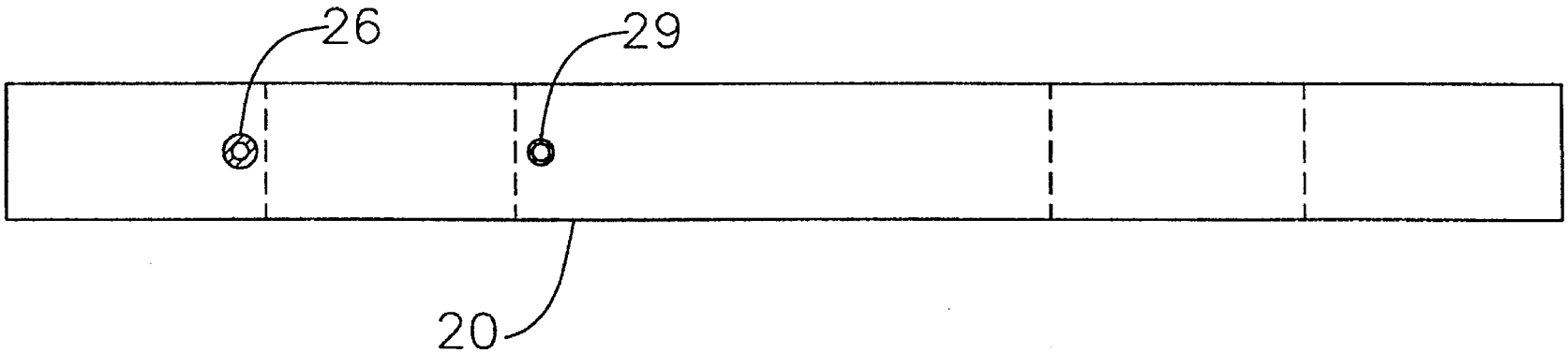
FIG. 13 is a plan view of the leg gusset of FIG. 12 with two flanges in place.

A leg gusset 20 is illustrated in FIGS. 12 and 13. In the preferred embodiment, the leg gusset is constructed from a unitary piece of weldable material that is rectangular in shape and is about 99 inches long by about 9 inches wide. A one inch diameter hole 32 is punched into the leg gusset about 14.5 inches from one side. A 0.62 inch diameter hole 33 is punched into the leg gusset about 34.5 inches from the same side as hole 32. A female flange 26 is inserted into hole 32 and a male flange 29 is inserted into hole 33. Both flanges are welded into place. In the preferred embodiment, both flanges are made out of urethane. The dimensions of the .leg gusset are to correspond to the size of the leg cell of the air mattress, being about 34 inches wide and about sixteen inches long.

Figure 14:
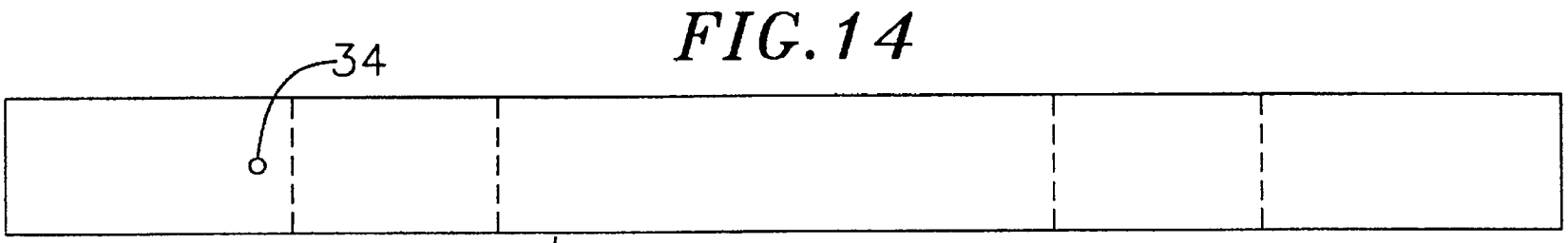
FIG. 14 is a plan view of a heel gusset of the present invention.

A heel gusset 21 is illustrated in FIG. 14. In the preferred embodiment, the heel gusset is constructed out of a unitary piece of weldable material that is rectangular in shape and is about 91 inches long by about 9 inches wide. A one inch diameter hole 34 is punched into the heel gusset about 14.5 inches from one side. A female flange 26 (not shown) is inserted into hole 34 and is welded into place. In the preferred embodiment, the flange is made out of urethane. The dimensions of the heel gusset are to correspond to the size of the heel cell of the air mattress, being about 34 inches wide and about twelve inches long.

Figure 15:
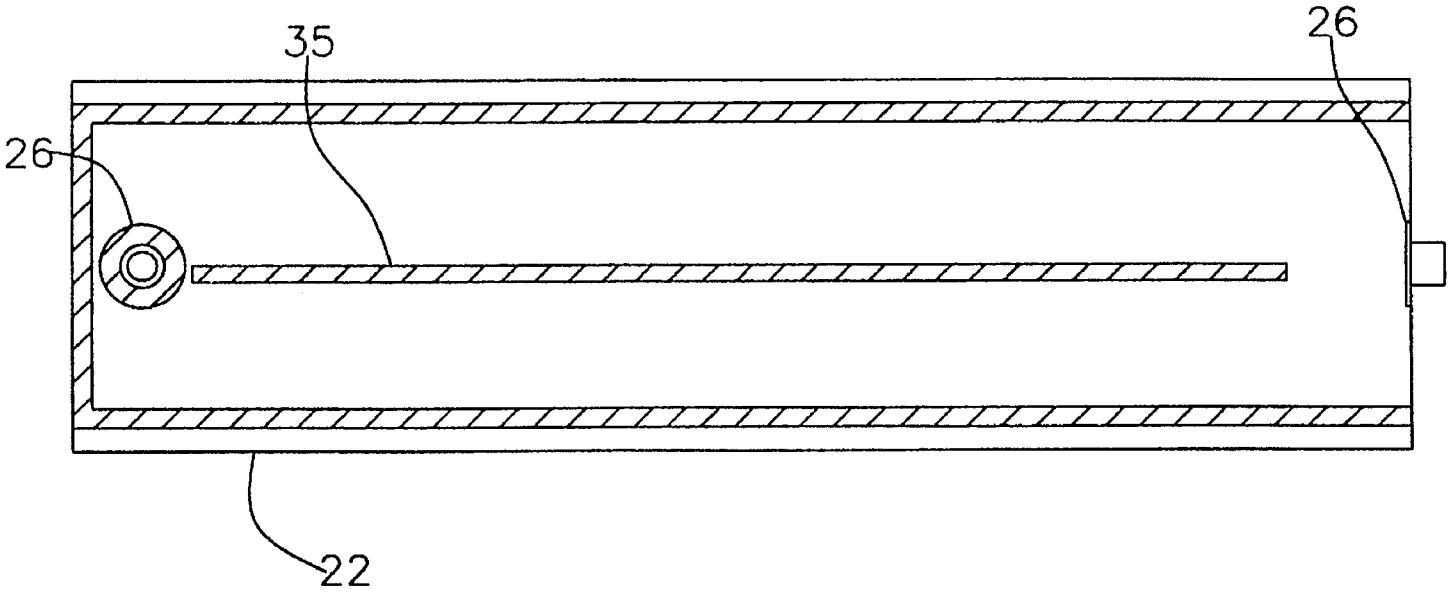
FIG. 15 is a side view partially in cross section of a manifold of the present invention.
Figure 15A:
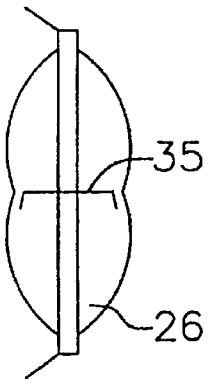
FIG. 15A is an end view of the manifold of FIG. 15.
Figure 16:
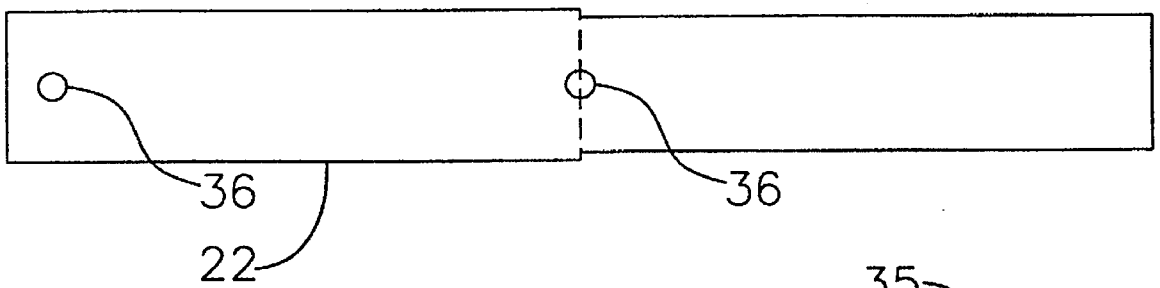
FIG. 16 is a plan view of the manifold of FIG. 15.
Figure 17:
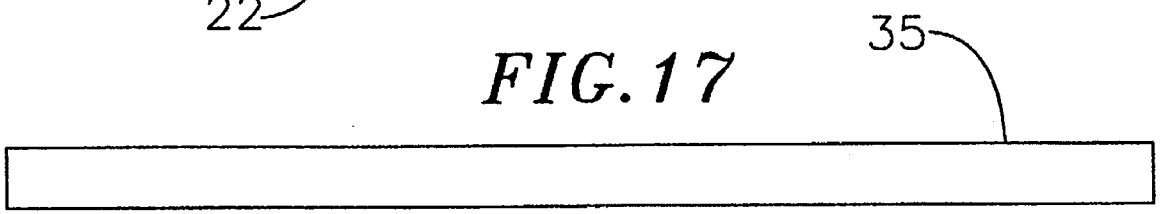
FIG. 17 is a plan view of a manifold baffle of the present invention.

An air manifold is illustrated in FIGS. 15, 15A, 16, and 17. In the preferred embodiment, the air manifold comprises a manifold bladder 22, a manifold rib 35, and two male flanges 26. The manifold bladder is constructed out of a unitary piece of weldable material that has two generally rectangular shape areas, the first and larger area being about 28 inches by about 9.75 inches and the second and smaller area being about 28 inches by about 9.0 inches. The two rectangular areas are joined along a smaller edge and are both centered as illustrated in FIG. 16. Two one inch holes are punched into the manifold bladder, one hole being punched in the larger rectangular area about 1.5 inches from its edge and the other hole being punched at the center junction of both rectangular areas. Two female flanges 26 are then welded to the manifold bladder, one flange in each hole. The manifold rib is illustrated in FIG. 17 and is made out of a unitary piece of weldable material that is about 25 inches long and about 1.5 inches wide.

The air mattress can be welded by any welding means well known in the art. The welds should be air tight welds that can withstand the pressure of a patient laying on the bed. In the preferred embodiment, the welds are created using a Hissen 100 kilowatt radio frequency (RF) welding machine manufactured in Taipei, Taiwan. The RF welding machine comprises two very large flat 6061-T6 aluminum plates and a source of RF energy. Dies are used to focus the RF energy to the welding area. 6061-T6 dies are used in the Hissen RF welding machine. To create long linear welds, long rectangular shaped aluminum dies are used. To create rectangular welds, open box-shaped aluminum ring dies are used that can be split apart near opposite corners of the box-shape. What is meant by the terminology "open box-shaped" is a rectangular six sided box shape that is missing two opposing sides of the box, and hence is open. To create circular welds, circular ring dies are used. As would be appreciated by a person skilled in the art of RF welding, the material to be welded is placed together and a sufficient amount of RF energy is supplied to the material via the welding machines's flat plates and dies to heat the material until a solid weld is formed.

The actual steps of manufacturing the air mattress is novel in that the baffles are simultaneously welded to the top and bottom pieces while the gussets are loosely in place. Then the gussets are simultaneously welded to the top and bottom pieces. This manufacturing process allows for the manufacture of the mattress with minimal amounts of time needed to weld the mattress together, and hence a substantial savings in manufacturing costs occurs.

The first step of the manufacturing process is to individually weld the male and female flanges into place in each of the gussets and the air manifold. The flanges are welded using appropriately sized circular ring dies.

Next, the nine wide inch free ends of each gusset are welded together to create a closed gusset with an open box-shaped structure. The free ends are welded to form a smooth butt-seam in the center of one side of the open box-shaped as depicted in FIG. 2.

The next step of the manufacturing process is to simultaneously weld the baffles to the top and bottom pieces. To accomplish these welds, the bottom piece is laid flat on the flat bottom plate in the Hissen RF welding machine. The lower edges of the fifteen baffles are then placed in location. The baffles are placed slightly off-center along the width of the bottom piece such that the ends of the baffles are about 3.5 inches from one side of the bottom piece and about 4.5 inches from the other side of the bottom piece. About 31 inches by about 7 inches by about ⅛ inch rectangular aluminum dies are then placed over the baffles, one die per baffle. The ⅛ inch edges provide the surface for welding, creating a ⅛ inch linear weld line. Because the dies are only about 7 inches tall and the baffles are about 9 inches tall, there are two inches of excess material height per baffle. Care is taken to center the baffles over the dies such that about one inch of material extends under the bottom of the die and one inch of material extends over the top of the die. Additionally, care is taken to make sure the material is laying flat without wrinkles or creases. The now open box-shaped gussets are loosely placed in location with the male and female flanges all lined up on the same side except for the center female flange that will be connected to the air manifold. Once all the gussets are in place, the top sheet is fitted over the dies and the top plate of the RF welding machine in placed over the top sheet. Again care must be taken to make sure that there are no wrinkles or creases in the material. Sufficient RF energy is then applied until the material of the baffles and of the top and bottom sheets is welded together. The baffle dies are then removed from the welding machine.

The next step of the process is to weld all the gussets simultaneously to the top and the bottom pieces. As indicated above, the gussets are loosely fitted in place prior to the welding of the baffles. Thus, the gussets are now located between the top and bottom pieces and baffles are welded inside the gussets to the top piece and to the bottom piece. Open box-shaped ring dies are then placed around each gusset. The ring dies separate along their length near opposite corners with smooth surfaces abutting each other. In other words, each open box-shaped ring die comes in two separate parts, each part containing two entire corners of the box, an entire width of the box, most of one length section of the box, and about two inches of the other length section of the box. The two parts are symmetrical and when abutted together make an entire open box-shaped ring die.

The open box-shaped ring dies are dimensioned to fit around each gusset. The ring die for welding the head gusset is an open box shape that is about 7 inches tall, about 36 inches long, and about 12 inches wide. The ring die for welding the chest gusset is about 7 inches tall, about 36 inches long and about 16 inches wide. The ring die for welding the center or pelvic gusset is about 7 inches tall, about 36 inches long and about 24 inches wide. The ring die for welding the leg gusset is about 7 inches tall, about 34 inches long and about 16 inches wide. The ring die for the heel gusset is about 7 inches tall, about 34 inches long and about 12 inches wide. Each edge of the ring dies is about ⅛ inch thick and this edge will produce about a ⅛ inch weld line.

Once the ring dies are in place around the gussets, the gussets are centered along the height of the ring dies such that a one inch margin of material wraps over the top and bottom edges of the ring die. Care is again taken to prevent wrinkling or creasing the gussets. In order to keep the gussets in place during welding, magnets are clipped to the gusset material extending over the free edge of the ring dies. The material of the gussets that make up the corners of the box-shape is carefully curved around the ring dies to minimize bunching. There can be some overlap of the corner material without compromising the integrity of the weld at the corners.

As is apparent from FIG. 2, in the preferred embodiment the leg and foot gussets are not centered along the width of the top and bottom pieces. The leg and foot gussets are located 1.5 inches away from one edge of the top and bottom pieces and 3.5 inches from the other edge. As indicated above, the baffles were welded slightly off-center. The off-center welds of the baffles are aligned with the gussets such that there is about 2 inches of distance from the ends of the baffles to the edge of the gussets that are opposite the manifold. The other ends of the baffles are about 3 inches from the manifold side edge of the head, chest, and center gussets, and about one inch from the manifold side edge of the leg and heel gussets. By placing the baffles and leg and heel gussets off-center there is enough room for the manifold to be welded later. When the ring dies are in place and the gussets are appropriately adjusted over and under the ring dies, the top plate of the RF welding machine is then located over the top piece and the gussets are welded together using an appropriate amount of RF energy.

In the embodiment utilizing the longer top piece, dividers are inserted between adjacent gussets during the welding process to sustain the necessary tension to form the V-shaped wedges from the top piece material. During the stage where the baffles are being welded to the top and bottom pieces, the top piece is placed on the bottom plate of the welding machine and short metallic dividers are used to create the V-shaped wedges. The baffles are placed as described above and the bottom piece is fitted over the baffles and the baffles are welded to the top and bottom pieces. Once the baffles have been welded, the assembly is turned over such that the bottom piece is now on the bottom plate of the welding machine. The gussets and the gusset dies are then fitted as described above and plastic wedges are placed to fold the top piece material into the V-shaped wedges which extend between adjacent gussets and to sustain the necessary tension in the top piece material during welding. The gussets are then welded to the top and bottom pieces with the dividers in place using the welding machine.

The manifold is welded together separately. First, the manifold bladder is folded between the junction of the two rectangular areas. The manifold rib is then welded to the two rectangular areas in the manifold bladder along the center line spaced 1.5 inches from the two edges of the manifold bladder as illustrated in FIG. 15. Last, the outer seams of the manifold bladder are then welded together. The manifold is then welded to the top and bottom pieces adjacent to the leg and heel gussets as indicated in FIG. 2. A simple rectangular die is used to create these welds.

Any excess material after welding is optionally removed to generate an aesthetically pleasing product.

The next step of the manufacturing process is to place the appropriate pressure inserts 11, 12, and 13 into male flanges of the internal air connectors between each gusset. The pressure inserts are placed as described above. The male flanges of the internal connectors are then fitted into the female flanges of the internal connectors.

The air inlet female sized flange of the center gusset near the manifold is then inserted into a ¾ inch inner diameter connector 23 as illustrated in FIG. 2. The connector 23 is also connected to a corresponding female sized flange located in the manifold. The air mattress assembly is then complete.

The air mattress is now ready for use in a hospital like environment. The air mattress can be placed on a foam pad such as part number 5016-2.6 DEN supplied by Bio Clinic Corporation, Ontario, Calif. to prevent the patient from bottoming out if the pressure in the air mattress suddenly drops. Additionally, a comforter or the like can be secured around the top and sides of the air mattress for additional comfort.

Once the air mattress is in place, a blower 37 is connected to the air manifold. The blower can be constant speed blower or a variable blower that allows for the user to select a range of pressures in the different sections. A variable speed blower that is suitable for use in the present invention is the Orthoderm Convertible II manufactured by Bio Clinic Corporation, Ontario, Calif. Another suitable blower would be one with the following specifications: maximum pressure of 19.5 inches of $H_2O$; maximum vacuum 18.7 inches $H_2O$; maximum airflow 19.5 SCFM; and a maximum temperature rise of 54° F. The blower provides a constant supply of air to the center section of the air mattress. The air in the center section can then either exit the center section through one of the holes in the top piece or can exit into either the chest section or the leg section via an internal air connector. Air in the chest section can either exit the air mattress through a hole in the top piece or can exit into the head section via an internal air connector. Air in the head section exits the air mattress through a hole in the top section. Air in the leg section can either exit the air mattress through a hole in the top piece or can exit into the heel section through an internal air connector. Finally, air in the heel section exits the air mattress through a hole in the top piece.

The flow of air creates discrete pressure zones in each section of the air mattress. Table I below indicates the relative pressures of each section using a variable speed blower that blows air at a slow rate for the soft setting and blows air at a fast rate for a firm setting. The pressures are in mm of Hg.

TABLE I

| SECTION | SOFT SETTING | FIRM SETTING |
|---|---|---|
| HEAD | 7.5 | 9.5 |
| CHEST | 9.5 | 13.5 |
| PELVIC | 11.0 | 15.5 |
| LEG | 4.0 | 6.0 |
| HEEL | 1.5 | 2.5 |

Thus, an inexpensive cellular air loss system is provided that can support a patient with different discrete zones of pressure and also have air flow through the top of the mattress to help prevent skin breakdown. The actual dimensions used in the illustrated embodiments can be modified to for different sized beds to suit different needs. Additionally, the inner diameters of the pressure inserts can be varied to adjust for different speed air blowers such that the appropriate pressure zones are created. Thus, the scope of the invention is not to be limited by the specification and is rather to be determined by the appended claims.

What is claimed is:

1. A cellular air loss mattress system comprising:

a unitary bottom piece;

a unitary top piece with a plurality of holes;

a plurality of gussets affixed to the top and bottom pieces to create respective cells for different mattress pressure zones;

a plurality of internal air flow connectors connecting the cells together wherein each internal air connector has a different internal diameter to regulate the flow of air between adjacent cells;

at least one air inlet into the cells connectable to air supply means, wherein air first flows into one of the cells and is then allowed to flow out of the holes in the top piece and to flow into adjacent cells via the internal connectors.

2. An air mattress system as recited in claim 1 wherein a plurality of baffles, located within the cells, are affixed to the top and bottom pieces, the length of each baffle being less than the width of the top and bottom pieces.

3. An air mattress system as recited in claim 2 wherein each baffle comprises a rectangular unitary piece having horizontal and vertical edges, the baffles being aligned along and positioned relative to the width of the top and bottom pieces such that a gap remains along the vertical edges of the baffles to provide a channel for air flow within the cells.

4. An air mattress system as recited in claim 3 in which the top and bottom pieces, the baffles, and the gussets are affixed to each other by RF welding techniques.

5. An air mattress system as recited in claim 1 wherein the top piece is folded downwardly in a plurality of sections to form small V-shaped wedges between adjacent cells.

6. An air mattress system as recited in claim 1 wherein each internal air flow connector between the cells comprises a female flange, a male flange, and a pressure insert, having a specified internal diameter, inserted into the female flange.

7. An air mattress system as recited in claim 1 wherein an air manifold located adjacent to at least one of the cells connects the air supply means to an air inlet into one of the cells.

8. An air mattress system as recited in claim 7 wherein the air manifold comprises:

a bladder formed from a unitary piece of material having two adjacent rectangular shaped areas, the material folded at the junction of the rectangular areas, and a rib located inside the bladder affixed to the two rectangular areas.

9. An air mattress system as recited in claim 1 wherein each gusset is formed from a unitary rectangular piece formed into an open box-shaped structure with approximately the same width as that of the top and bottom pieces.

10. An air mattress system as recited in claim 1 wherein a head gusset, a chest gusset, a pelvic gusset, a leg gusset, and a heel gusset are affixed to the top and bottom pieces to form corresponding cells defining different pressure zones.

11. An air mattress system as recited in claim 10 wherein the air supply means is connected to an air inlet in the pelvic gusset and the diameters of the internal air connectors are adjusted such that the pressure in the mattress decreases as air moves from the pelvic cells gusset into adjacent cells.

12. An air mattress system as recited in claim 10 wherein the relative pressures within the cells in mm of Hg generally fall within the following ranges:

| | |
|---|---|
| Head | 7.5–9.5 |
| Chest | 9.5–13.5 |
| Pelvic | 11.0–15.5 |
| Leg | 4.0–6.0 |
| Heel | 1.5–2.5. |

13. An air mattress system as recited in claim 10 including an air manifold adjacent to the leg and heel gussets and connected to the pelvic cell so that air from the air supply means travels through the manifold into an air inlet located in the pelvic gusset.

14. A cellular air loss mattress system comprising:

a unitary bottom piece a unitary top piece with a plurality of holes;

a plurality of gussets, including a pelvic gusset, welded to the top and bottom pieces to create cells of different pressure zones;

internal air connectors connecting the cells together wherein each internal air connector has a different internal diameter to regulate the flow of air between adjacent cells;

an air inlet into the pelvic cell; and air supply means connectible to the air inlet wherein air first flows into the pelvic cell and is then allowed to flow out of the holes in the top piece and to flow into adjacent cells via the internal connectors.

* * * * *